US006702616B1

(12) United States Patent
Chang et al.

(10) Patent No.: US 6,702,616 B1
(45) Date of Patent: Mar. 9, 2004

(54) RETAINING TERMINAL STRUCTURE OF CONNECTOR

(75) Inventors: Chi-Sen Chang, Taipei (TW); Yun-Yu Liu, Taipei (TW); Yi-Sheng Lin, Taipei (TW)

(73) Assignee: North Star Systems Corp., Taipei (TW)

( * ) Notice: Subject to any disclaimer, the term of this patent is extended or adjusted under 35 U.S.C. 154(b) by 0 days.

(21) Appl. No.: 10/462,658

(22) Filed: Jun. 17, 2003

(51) Int. Cl.[7] ..... H01R 13/648
(52) U.S. Cl. ..... 439/607; 439/95; 439/357
(58) Field of Search ..... 439/108, 358, 439/181, 357, 607, 95

(56) References Cited

U.S. PATENT DOCUMENTS 4,838,811 A * 6/1989 Nakamura et al. ..... 439/607
5,797,770 A * 8/1998 Davis et al. ..... 439/607
6,146,182 A * 11/2000 Wang et al. ..... 439/357
6,287,146 B1 * 9/2001 Avery et al. ..... 439/607
6,447,311 B1 * 9/2002 Hu et al. ..... 439/108

* cited by examiner

*Primary Examiner*—Hae Moon Hyeon
(74) *Attorney, Agent, or Firm*—Troxell Law Office PLLC

(57) ABSTRACT

A retaining terminal structure of a connector is for serving as a retaining terminal that provides retaining and positioning effects when assembling a connector. The retaining terminal as a formed integral by metal extrusion includes an L-shaped corner portion; a butting portion formed at a top portion thereof and for serving as butting ground guidance with a connected connector, so as to prevent electrostatic discharge (ESD); and a retaining portion formed at a side thereof and for serving as a retaining member when the retaining terminal is corresponded and assembled. Using the integrated structure of the retaining terminal having ground guidance, and retaining and positioning effects, a number of terminals and retaining components at an interior of the connector is reduced, thereby decreasing steps and production expenses needed for assembly of the connector.

3 Claims, 5 Drawing Sheets

RETAINING TERMINAL STRUCTURE OF CONNECTOR

BACKGROUND OF THE INVENTION (a) Field of the Invention

The invention relates to a retaining terminal structure of a connector, and more particularly, to a retaining terminal structure serving as ground guidance and providing retaining and positioning effects when being corresponded and assembled to the connector, thereby reducing a number of terminals and retaining components at an interior of the connector for further decreasing steps and production expenses needed for assembly thereof.

(b) Description of the Prior Art

Connectors are extensively applied in electronic appliances as links between signal sources and various electronic appliances or equipments. These connectors allow the signal sources to carry out bi-directional transmissions of signals or power supplies with the connected electronic appliances or equipments. Should incomplete connection or loosening occur in any of the above components, complications such as interferences or short-circuits are likely to happen, and thus leading to interruptions or malfunctions of signal lines therein. Therefore, it is vital to reinforce connection structures between a plug and a receptacle of a connector for maintaining unobstructed wire linkage thereof.

In a prior connector, connection techniques are developed according to material characteristics of connecting terminals, or corresponding retaining structures of plastic housings thereof for connection. However, it is well-known among connector industrialists that, in order to prevent electrostatic discharge (ESD), a crucial design factor of a connector is to maintain normal conductance and ground guidance of connecting terminals of two corresponding plug and receptacle of a connector. Yet, owing to complication trend of signals to be transmitted, numbers of connecting terminals needed in connectors are multiplied accordingly. Therefore, it is evident that integrated structures having retaining structures and grounding elements of connectors shall bring great advantages toward production cost and defective rate thereof.

SUMMARY OF THE INVENTION

The primary object of the invention is to provide a retaining terminal structure of a connector having quick assembly and excellent retaining effects, thereby enhancing strength of the connector.

The secondary object of the invention is to provide a retaining terminal structure of a connector capable of serving as a terminal structure for ground guidance after being assembled, thereby reducing a number of components within the connector and for further decreasing assembly steps and production expenses of the connector.

To achieve the aforesaid objects, the invention comprises a pair of corresponding retaining terminals disposed at two sides at an interior of a connector. The retaining terminal is an L-shaped integral formed by metal extrusion. A top portion of the retaining terminal is formed with a butting portion for ground guidance. A longitudinal side of the retaining terminal formed with a retaining portion serving as a retaining member when being corresponded in the connector. Using the integrated design that provides ground guidance, and retaining and position effects, a number of terminals and retaining components within a connector is reduced, thereby decreasing assembly steps and production expenses of the connector.

DETAILED DESCRIPTION OF THE PREFERRED EMBODIMENTS

To better understand the invention, detailed descriptions shall be given with the accompanying drawings hereunder.

Figure 1:
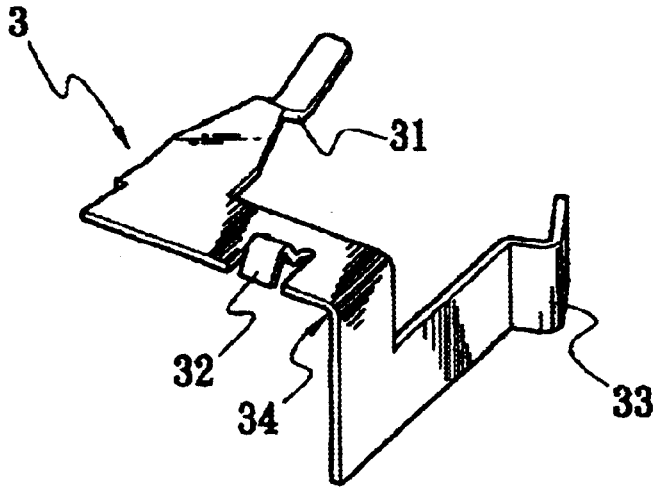
FIG. 1 shows an elevational view according to the invention.

Referring to FIG. 1, a retaining terminal 3 in a connector according to the invention comprises an L-shaped corner portion 34, a retaining portion 33, a butting portion 31 and a positioning portion 32. The L-shaped corner portion 34 is for providing the retaining terminal 3 with positioning benchmark of insertion when the retaining terminal 3 is disposed at the connector, and also for preventing displacement of the retaining portion 33 at the side during retaining process thereof.

A top portion of the retaining terminal 3 is extended forward to form a butting portion 31. The butting portion 31 is an arched and elastic piece for ground guidance. A top rear end of the retaining terminal 3 is formed with a positioning portion 32. The positioning portion 32 is a hunched elastic piece serving as a positioning limit when inserting and pushing the retaining terminal 3 forward. A longitudinal side of the L-shaped corner portion 34 of the retaining terminal 3 is extended forward to form a retaining portion 33. The retaining portion 33 is an elastic piece bent with a right angle, and serves as a retaining member when being placed in the connector.

Figure 2:
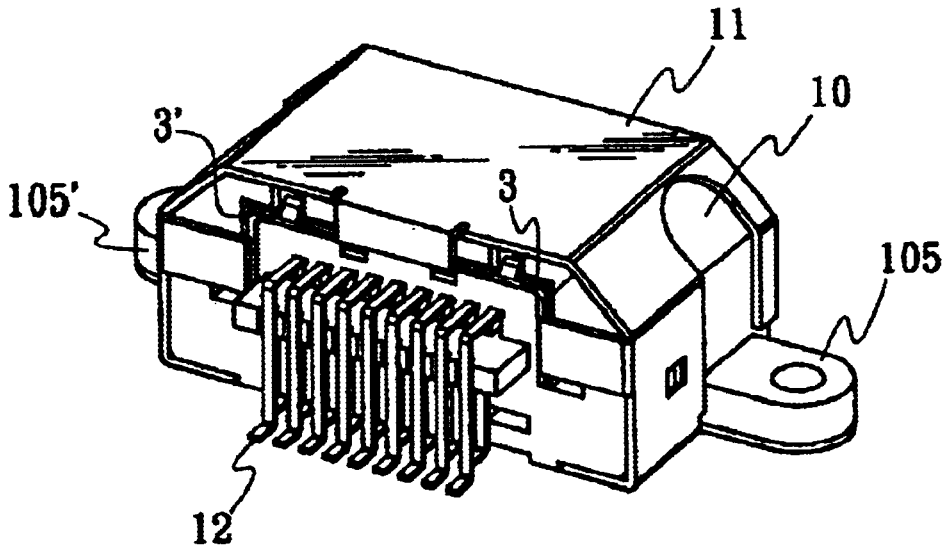
FIG. 2 shows an elevational view illustrating a retaining terminal in a preferred embodiment according to the invention.
Figure 3:
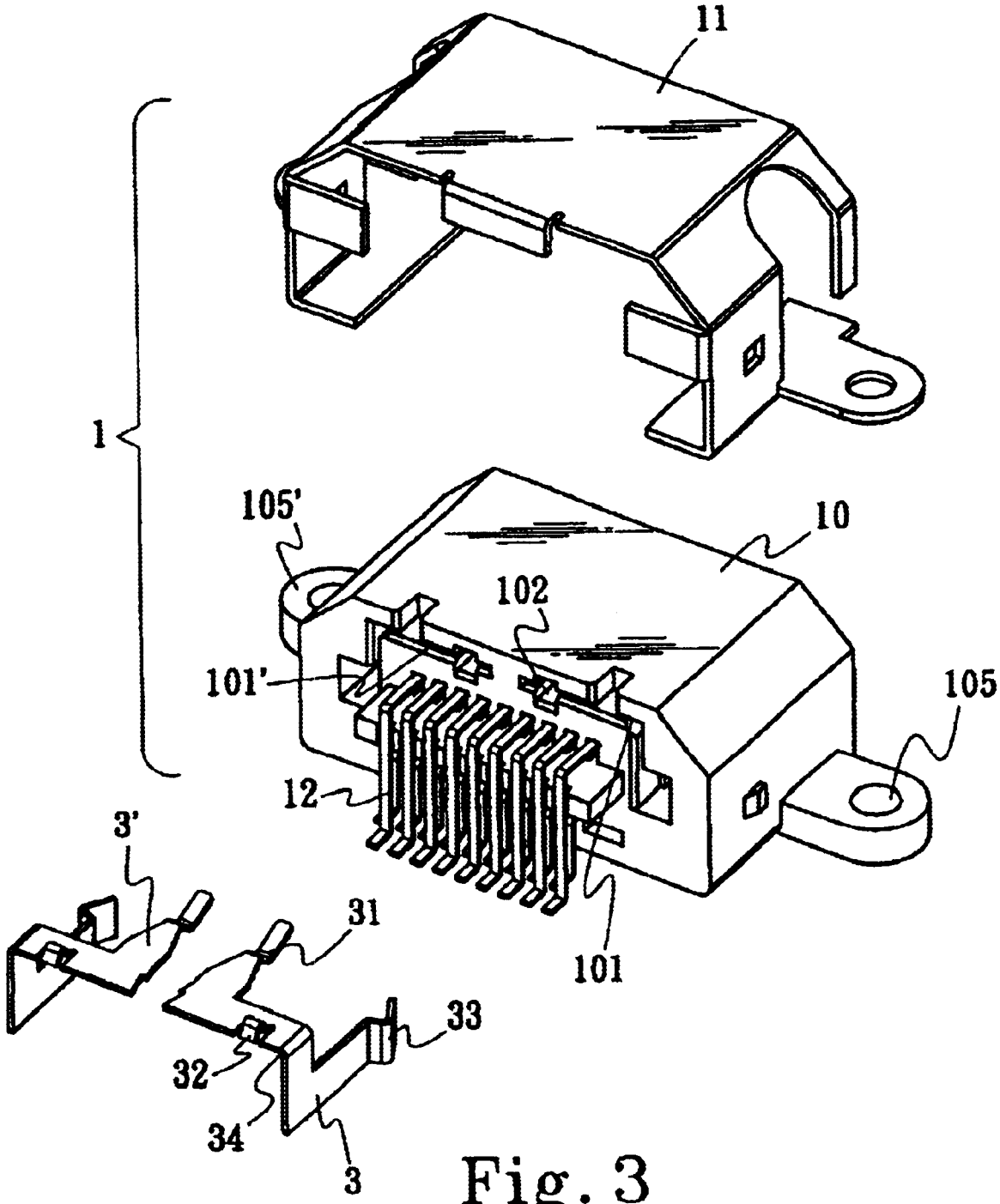
FIG. 3 shows an exploded elevational view illustrating a retaining terminal in a preferred embodiment according to the invention.
Figure 4:
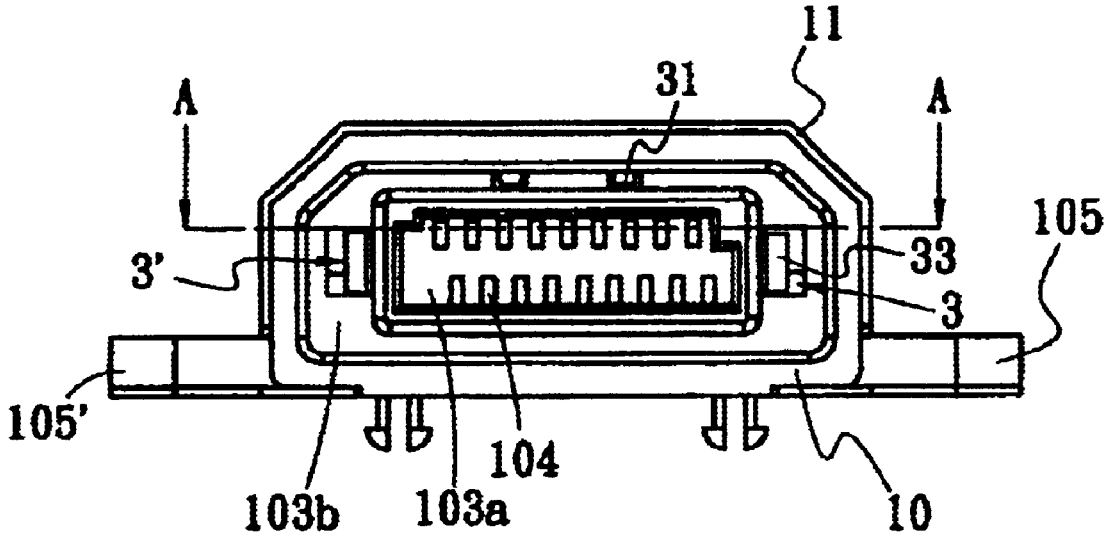
FIG. 4 shows a front view illustrating a retaining terminal in a preferred embodiment according to the invention.

Referring to FIGS. 2, 3 and 4 showing an elevational view, an exploded view and a front view of a preferred embodiment according to the invention, respectively, the retaining terminal 3 according to the invention is embedded within a receptacle connector housing 1. The receptacle connector housing 1 comprises a base 10, a metal housing 11 and a plurality of connecting terminals 12.

Figure 5:
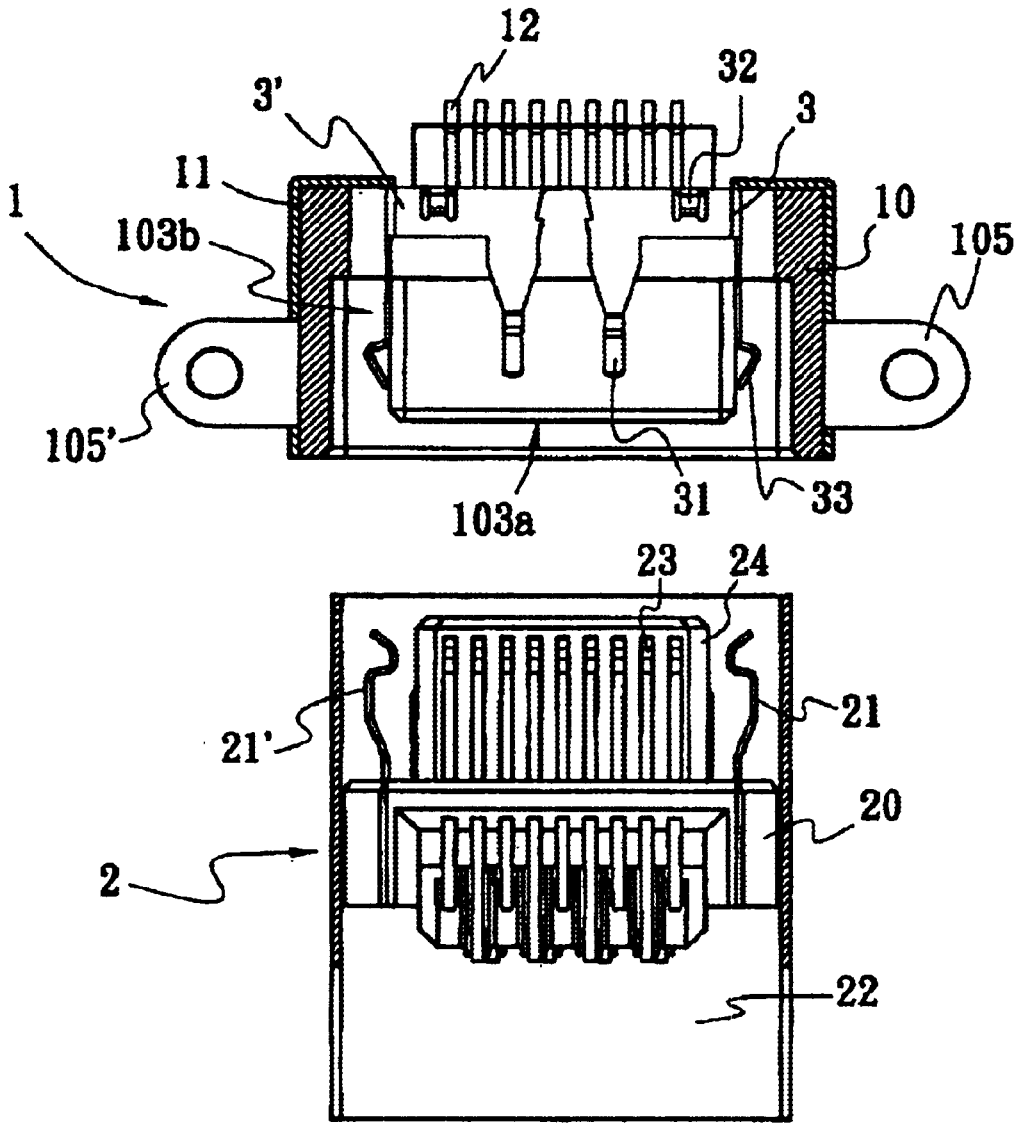
FIG. 5 shows a top sectional view along A—A for illustrating a retaining terminal in a preferred embodiment according to the invention.

The base 10 is an insulation integral formed by plastic extrusion, and is also formed with an inner accommodation chamber 103*a* and an outer accommodation chamber 103 for inserting a plug connector 2 as shown in FIG. 5. In addition, the inner accommodation chamber 103*a* is disposed with a plurality of slots 104 for placing the connecting terminals 12 that act as terminals connecting and guiding signals.

Outer lateral sides of the base 10 are provided with a pair of symmetrical lugs 105 and 105', and are enveloped with a metal housing 11. The lugs 105 and 105' function as a base for securing the entire receptacle connector housing 1, and the metal housing 11 is enveloped round the entire receptacle connector housing 1 and functions as round guidance for a connected motherboard or a host housing. Rear walls of the base 10 are opened and provided with a pair of symmetrical L-shaped slots 101 and 101' for corresponding with an outer accommodation chamber 103*b* at the interior of the base 10. The L-shaped slots 101 and 101' are for placing a corresponding pair of retaining terminals 3 and 3', and one end of the L-shaped slots 101 and 101' is respectively disposed with a positioning slot 102 serving as a positioning limit when inserting and pushing the positioning portion 32 of retaining terminal 3 forward.

Using designs of the L-shaped corner portion 34 of the retaining terminal 3 and the L-shaped slots 101 of the base, the retaining terminal 3 according to the invention is accurately corresponded and assembled to the base 10. The retaining portion 33 and the butting portion 31 of the retaining terminal 3 are extended into the outer accommodation chamber 103*b* of the base 10. The retaining terminal 3 is considered to have completed thorough assembly with the base 10 when the positioning portion 32 of the retaining terminal 3 and the positioning slot 102 have reached the positioning limit thereof by pushing forward.

Figure 6:
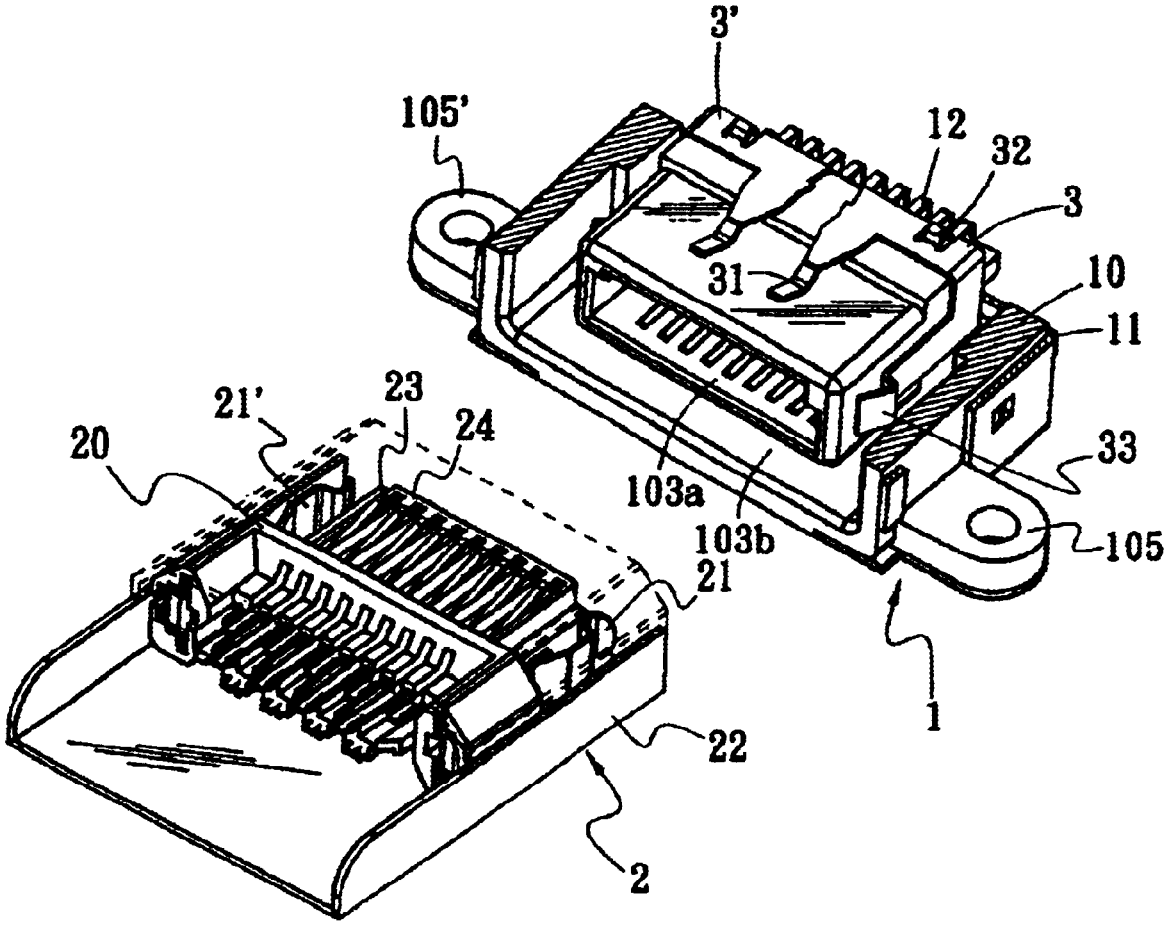
FIG. 6 shows an elevational sectional view along A—A for illustrating a retaining terminal in a preferred embodiment according to the invention.

Referring to FIGS. 5 and 6, the plug connector 2 is formed with an insertion end 24 on a base 20 thereof, and the insertion end 24 is embedded with a plurality of connecting terminals 23. Two sides of the base 10 are disposed with two corresponding fastening pieces 21 and 21' for correspondingly binding the retaining terminals 3 and 3'. The base 20 is further enveloped with a metal housing 22 for ground guidance.

When the plug connector 2 is joined with the receptacle connector housing 1, the insertion end 24 of the plug connector 2 is corresponded to the inner accommodation chamber 103*a* of the receptacle connector housing 1, such that the connecting terminals 12 and 23 are conducted. At this point, the fastening pieces 21 and 21' of the plug connector 2 are retained with the retaining portion 33 of the retaining terminal 3 situated in the outer accommodation chamber 103*b*, thereby completing assembly of the plug connector 2 and the receptacle connector housing 1. Wherein, the fastening pieces 21 and 21', and the retaining terminal 3 are made of metal materials, as well as having appropriate elasticity and excellent conductance, and therefore the retaining portion 33 and the fastening pieces 21 and 21' are capable of appropriate elastic deformation.

When the plug connector 2 and the receptacle connector housing 1 are assembled, the metal housing 22 enclosing an outer periphery of the base 20 is butted against and joined with the butting portion 31 of the retaining terminal 3 in the outer accommodation chamber 103*b*. Through conductance of the retaining terminal 3 with the metal housing 11 of the receptacle connector housing 1, grounding between the plug connector 2 and the receptacle connector housing 1 is conducted with a motherboard or a computer host housing connected by the receptacle connector housing 1.

Conclusive from the above, the retaining terminal structure of a connector in accordance with the invention is capable of providing a terminal structure having quick assembly and excellent retaining effects, as well as serving as ground guidance after being embedded, thereby reducing a number of components needed in a connector for further decreasing steps and production expenses of assembly.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A retaining terminal structure of a connector at least comprising an L-shaped corner portion, a retaining portion, a butting portion and a positioning portion, and being characterized that:

the L-shaped corner portion is for providing the retaining terminal with positioning benchmark of insertion when the retaining terminal is disposed at the connector, and also for preventing displacement of the retaining portion at the side during retaining process thereof;

the retaining portion is formed by extending a longitudinal side of the L-shaped corner portion of the retaining terminal forward, and is an elastic piece bent with a right angle for serving as a retaining member when being placed in the connector;

the buffing portion is formed by extending a top front portion of the retaining terminal, and has an arched and elastic piece extended forward for ground guidance of the retaining terminal;

the positioning portion is formed at a top rear end of the retaining terminal, and is a hunched elastic piece serving as a positioning limit when inserting and pushing the retaining terminal forward; and the aforesaid retaining terminal structure is for serving as ground guidance and providing retaining and positioning effects when being corresponded into the connector, and is an integral formed by metal extrusion, thereby reducing a number of components within the connector.

2. The retaining terminal structure of a connector in accordance with claim 1, wherein the retaining terminal is disposed in either a plug connector or a receptacle connector, and serves as a retaining member when the plug connector and the receptacle connector are being joined.

3. The retaining terminal structure of a connector in accordance with claim 1, wherein the retaining terminal is disposed in either a plug connector or a receptacle connector, and serves as ground guidance when the plug connector and the receptacle connector are being joined.

* * * * *